US012410543B1

(12) United States Patent
Booth et al.

(10) Patent No.: US 12,410,543 B1
(45) Date of Patent: Sep. 9, 2025

(54) WOVEN SILT FENCE FABRICS INCLUDING TWO OR MORE DISTINCTLY DIFFERENT COLORS OF WARP YARNS IN THE MACHINE DIRECTION

(71) Applicant: Willacoochee Industrial Fabrics, Inc., Willacoochee, GA (US)

(72) Inventors: Eric Lee Booth, Nashville, GA (US); Melissa Grace, Gulf Breeze, FL (US); Kevin William Ray, Enigma, GA (US)

(73) Assignee: Willacoochee Industrial Fabrics, Inc., Nashville, GA (US)

( * ) Notice: Subject to any disclaimer, the term of this patent is extended or adjusted under 35 U.S.C. 154(b) by 0 days.

(21) Appl. No.: 18/825,595

(22) Filed: Sep. 5, 2024

Related U.S. Application Data

(60) Provisional application No. 63/662,305, filed on Jun. 20, 2024.

(51) Int. Cl.

| | |
|---|---|
| ***E04H 17/00*** | (2006.01) |
| ***D03D 15/54*** | (2021.01) |
| *D03D 1/00* | (2006.01) |

(52) U.S. Cl.
CPC ..... *D03D 15/54* (2021.01); *E04H 17/00* (2013.01); *D10B 2505/18* (2013.01)

(58) Field of Classification Search
CPC ..... D03D 15/54; E04H 17/00; D10B 2505/18
See application file for complete search history.

(56) References Cited

U.S. PATENT DOCUMENTS

| | | | | |
|---|---|---|---|---|
| 926,310 | A * | 6/1909 | Zepp et al. | D03D 23/00 139/418 |
| 1,812,640 | A * | 6/1931 | Nutter | D03D 39/00 139/391 |
| 2,186,814 | A * | 1/1940 | Adams | D04B 15/78 318/692 |
| 5,114,272 | A * | 5/1992 | Brunhoff | E02B 15/08 405/72 |
| 5,532,598 | A * | 7/1996 | Clark, Jr. | G01V 15/00 324/67 |
| 5,827,612 | A * | 10/1998 | Girgis | C03C 25/50 427/407.1 |
| 5,925,462 | A * | 7/1999 | Girgis | G02B 6/443 385/103 |
| 6,367,781 | B1 | 4/2002 | Flynn et al. | |
| 6,778,181 | B1 * | 8/2004 | Kilgariff | G06T 15/005 345/582 |
| 6,835,027 | B1 * | 12/2004 | Glass | F16B 15/0015 405/303 |

(Continued)

OTHER PUBLICATIONS

AASHTO Designation: M 288-00; Standard Specification for Geotextile Specification for Highway Applications; 2000; 20 pages.

(Continued)

*Primary Examiner* — Robert H Muromoto, Jr.
(74) *Attorney, Agent, or Firm* — Harness, Dickey & Pierce, P.L.C.; Anthony G. Fussner

(57) ABSTRACT

A woven silt fence fabric includes two or more distinctly different colors of warp yarns in the machine direction. The woven silt fence fabric includes a first woven fabric portion to be installed in the ground having a first color that is distinctly different from a second color of a second woven fabric portion to be installed and remain exposed above the ground.

33 Claims, 8 Drawing Sheets

(56) References Cited

U.S. PATENT DOCUMENTS 7,499,890 B1 * 3/2009 Allen ..... G06Q 30/0283 705/400
8,747,027 B1 6/2014 Singleton
9,404,233 B2 8/2016 Jones et al.
9,777,455 B2 * 10/2017 Sutton ..... D03D 15/46
10,145,080 B2 12/2018 Segroves et al.
10,508,400 B2 * 12/2019 Booth ..... E02D 17/202
11,174,612 B2 * 11/2021 Booth ..... D03D 15/567
11,634,880 B2 4/2023 Segroves et al.
11,873,588 B2 1/2024 Ray et al.
2004/0159345 A1 * 8/2004 Gower ..... E04H 9/14 135/87
2004/0213637 A1 * 10/2004 Ianniello ..... B09B 1/00 405/302.6
2005/0048225 A1 * 3/2005 Morris ..... B32B 25/10 428/17
2005/0170726 A1 * 8/2005 Brunson ..... B32B 5/022 428/218
2006/0133900 A1 * 6/2006 Singleton ..... E02D 17/20 405/302.7
2010/0229998 A1 * 9/2010 Ruan ..... D04C 1/06 139/420 R
2010/0326904 A1 * 12/2010 Lord ..... C02F 3/30 210/150
2011/0200390 A1 * 8/2011 Rodriguez ..... E02D 5/10 405/38
2015/0337410 A1 * 11/2015 Dimitrakis ..... C22B 3/18 75/10.13
2016/0348333 A1 * 12/2016 Sutton ..... E01C 3/003
2018/0200608 A1 * 7/2018 Sadick ..... B32B 5/022
2019/0145068 A1 * 5/2019 Zock ..... C02F 1/004 256/12.5
2019/0352859 A1 * 11/2019 Hartman ..... E01C 9/004
2023/0265633 A1 8/2023 Segroves et al.
2023/0304249 A1 9/2023 Ray et al.
2023/0312417 A1 * 10/2023 Arakel ..... C04B 28/10 71/14
2023/0340749 A1 * 10/2023 Eicher ..... E02D 17/202
2023/0401274 A1 * 12/2023 Denninghoff ..... G06Q 30/0251

OTHER PUBLICATIONS

WINFAB 2098R, Certificate of Compliance, Mar. 18, 2024, 1 page.
Dubinsky, Performance Evaluation of Two Silt Fence Geosynthetic Fabrics During and After Rainfall Event, https://stars.library.ucf.edu/etd/4715, 2014, 158 pages.
New York Department of Transportation Standard Specification Section 737—Geosynthetics, Engineering Instruction EI 14-003; Sep. 28, 2015, 28 pages.
Beltech 1935 Georgia DOT Silt Fence Product Data Sheet, www.beltonindustries.com; Jun. 2014, 1 page.

* cited by examiner

WOVEN SILT FENCE FABRICS INCLUDING TWO OR MORE DISTINCTLY DIFFERENT COLORS OF WARP YARNS IN THE MACHINE DIRECTION

CROSS-REFERENCE TO RELATED APPLICATION

This application claims priority to and the benefit of U.S. Provisional Patent Application No. 63/662,305 filed Jun. 20, 2024. The entire disclosure of the above application is incorporated herein by reference.

FIELD

The present disclosure relates to woven silt fence fabrics including two or more distinctly different colors of warp yarns (e.g., tape yarn, fibrillated tape yarn, monofilament yarn, multifilament yarn, spun yarn of any type, etc.) in the machine direction, such that the fabric includes a first woven fabric portion or section to be installed in the ground having a first color that is distinctly different from a second color of a second woven fabric portion or section to be installed and remained exposed above the ground.

BACKGROUND

This section provides background information related to the present disclosure which is not necessarily prior art.

Silt fences, also known as filter fences or sediment barriers, are commonly utilized in erosion control efforts. They are typically installed within a trench approximately 6 inches deep, supported by posts, as depicted in FIGS. 1 and 2. An example of specifications for temporary silt fences can be found in Appendix A to U.S. Provisional Patent Application No. 63/662,305 that includes information sourced from the Georgia Department of Transportation and that is fully incorporated herein.

These silt fence fabrics are strategically placed near construction zones or other areas where natural soil may be disturbed. During rainfall, disturbed soil can wash away, causing runoff that contaminates water bodies and exacerbates soil erosion. Silt fences act as temporary solutions to prevent such issues. Proper installation involves burying the fabric in a trench in the soil, typically 6 to 8 inches deep, while leaving a portion exposed above ground, usually 18 to 30 inches in height. The fabric is supported by posts or stakes (wood, metal, or synthetic) spaced at intervals along the fence. These posts are essential for maintaining the fence's upright position and stability against the forces of soil and water movement. Importantly, silt fences are designed to permit water flow while trapping sediment and soil, thereby reducing runoff and erosion.

DRAWINGS

The drawings described herein are for illustrative purposes only of selected embodiments and not all possible implementations and are not intended to limit the scope of the present disclosure.

Corresponding reference numerals may indicate corresponding (but not necessarily identical) parts throughout the several views of the drawings.

DETAILED DESCRIPTION

Example embodiments will now be described more fully with reference to the accompanying drawings.

Disclosed herein are exemplary embodiments of woven silt fence fabrics including two or more (e.g., two, three, four, more than four, etc.) distinctly different colors (e.g., orange, black, green, yellow, red, blue, etc.) of warp yarns (e.g., tape yarn, fibrillated tape yarn, monofilament yarn, multifilament yarn, spun yarn of any type, etc.) in the machine direction. The woven silt fence fabric includes a first woven fabric portion or section to be installed in the ground having a first color that is distinctly different from a second color of a second woven fabric portion or section to be installed above the ground.

Figure 1:
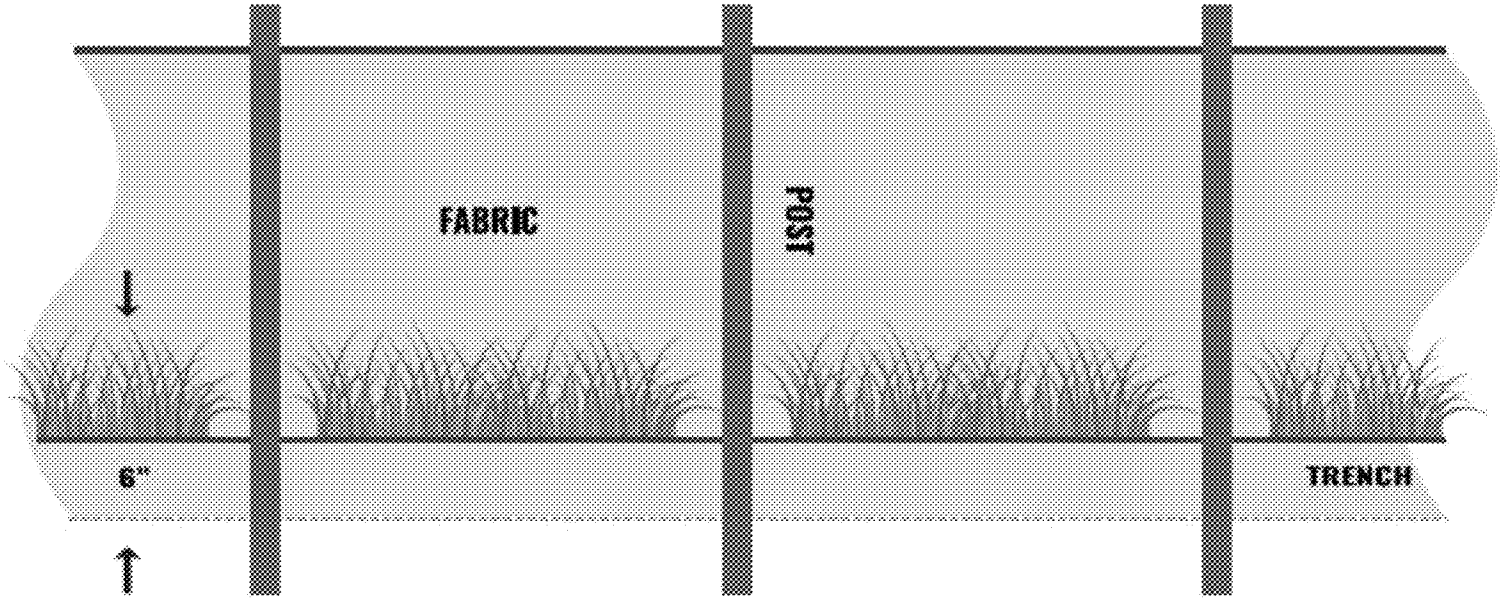
FIG. 1 (Prior Art)
FIGS. 1 and 2 are front and side views of an exemplary silt fence installed within a 6-inch deep trench and supported by posts.
Figure 2:
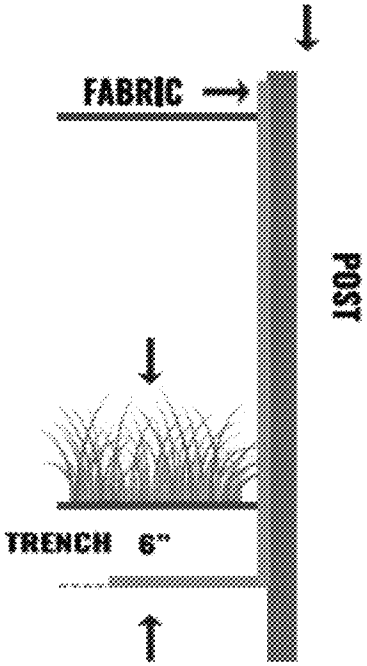
FIG. 2 (Prior Art)
Figure 3:
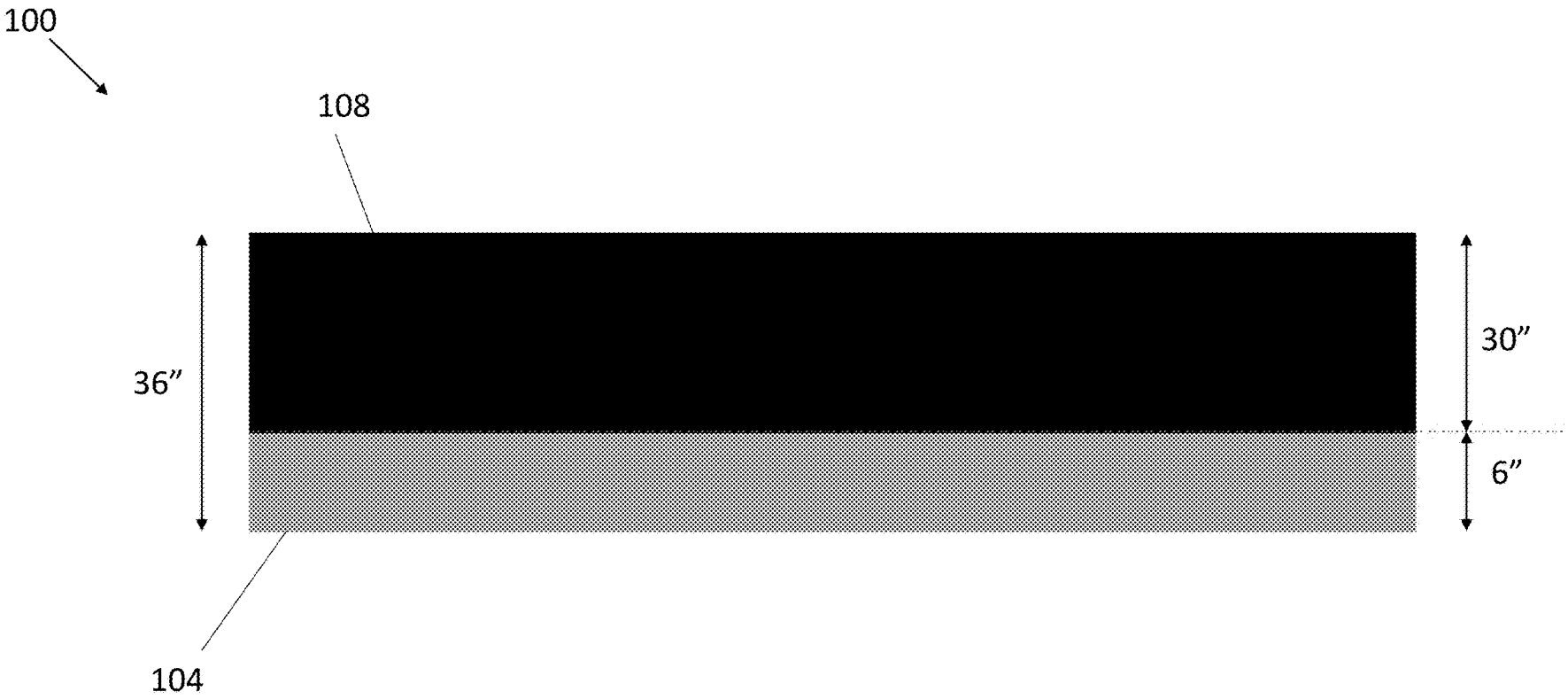
FIG. 3 illustrates a multi-colored woven silt fence fabric according to an exemplary embodiment of the present disclosure.
Figure 4:
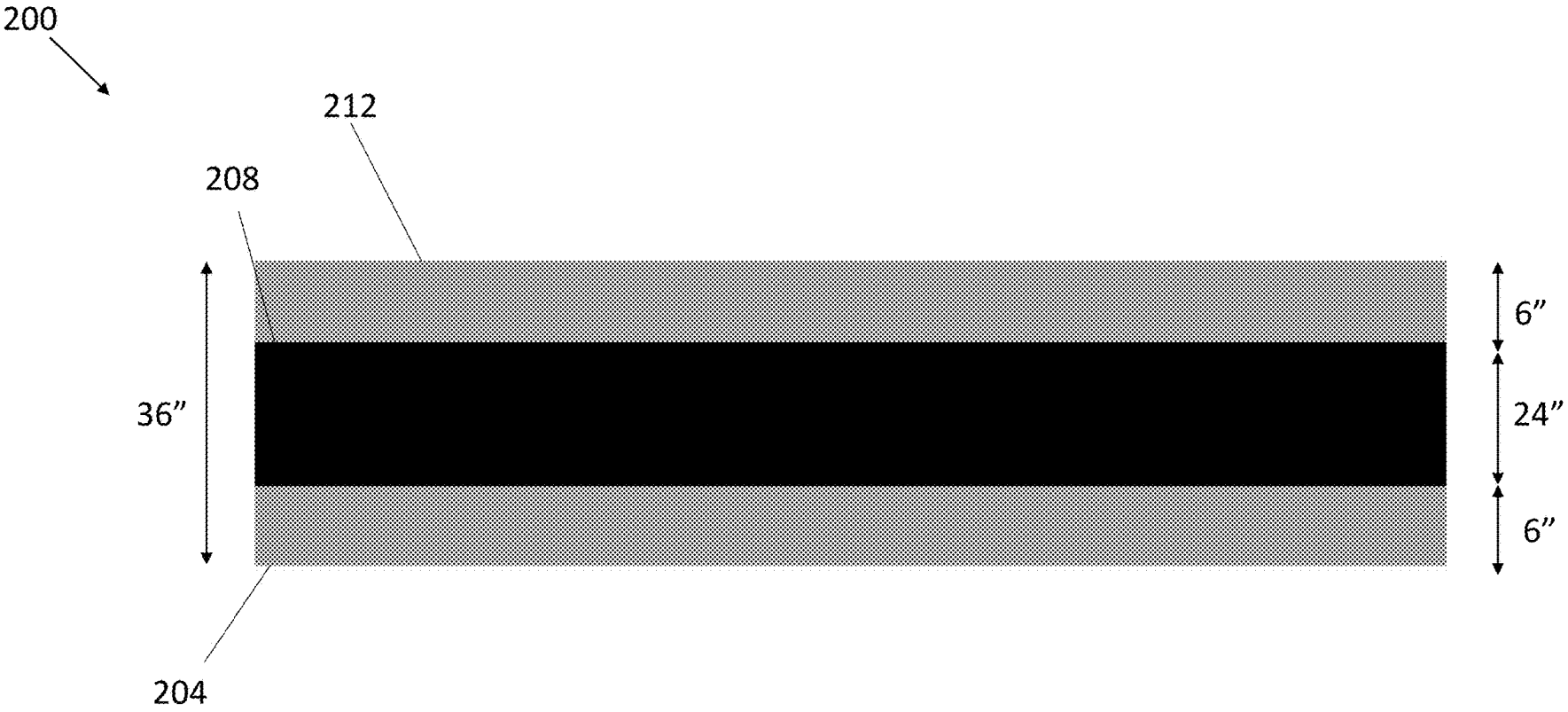
FIG. 4 illustrates a multi-colored woven silt fence fabric according to an exemplary embodiment of the present disclosure.
Figure 5:
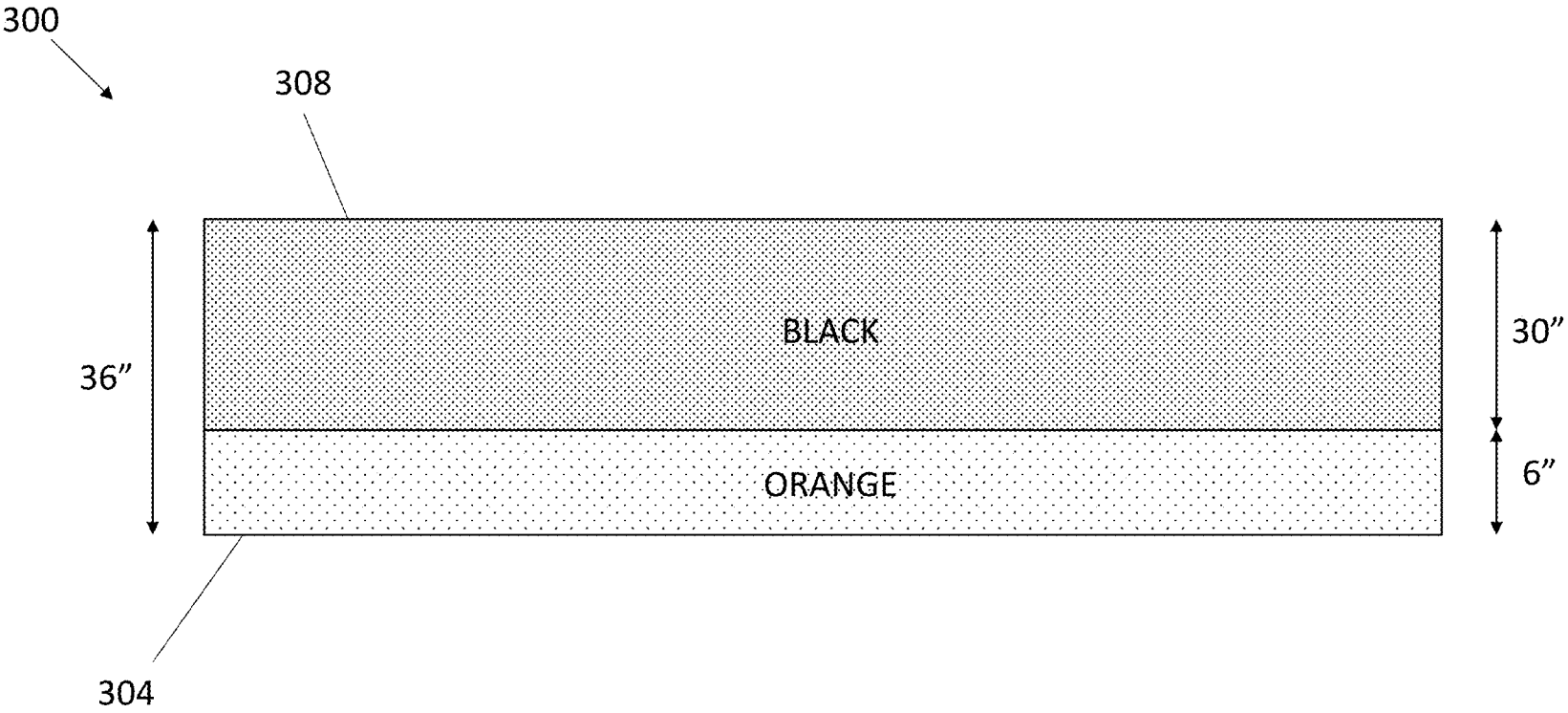
FIG. 5 illustrates a multi-colored woven silt fence fabric according to an exemplary embodiment of the present disclosure. The dimensions in inches and the colors are provided as examples only.

In exemplary embodiments, the woven silt fence fabric includes two woven fabric portions or sections (e.g., FIGS. 3 and 5 etc.). But in other exemplary embodiments, the woven silt fence fabric includes more than two woven fabric portions or sections (e.g., three, four, five, more than five woven fabric portions or sections, etc.). For example, another exemplary embodiment of a silt fence fabric (e.g., FIGS. 4 and 6, etc.) includes first, second, and third woven fabric portions or sections having respective first, second, and third colors (e.g., green, yellow, red, blue, yellow, black, orange, etc.) wherein at least one of the first, second, and third colors is distinctly different from at least one of the other first, second, and third colors. A further exemplary embodiment of a silt fence fabric (e.g., FIG. 7, etc.) includes first, second, third, and fourth woven fabric portions or sections having respective first, second, third, and fourth colors (e.g., green, yellow, red, blue, yellow, black, orange, etc.) wherein at least one of the first, second, third, and fourth colors is distinctly different from at least one of the other first, second, third, and fourth colors. An additional exemplary embodiment of a silt fence fabric (e.g., FIG. 8, etc.) includes first, second, third, fourth, and fifth woven fabric portions or sections having respective first, second, third, fourth, and fifth colors (e.g., green, yellow, red, blue, yellow, black, orange, etc.) wherein at least one of the first, second, third, fourth, and fifth colors is distinctly different from at least one of the other first, second, third, fourth, and fifth colors.

In exemplary embodiments, the distinctly different colors of the woven silt fence fabric may provide one or more of the following advantages, such as the ability to clearly identify a particular dimension of the woven silt fence fabric for reference during installation, preferences to a particular color by some end users, and/or satisfy specifications for requirements of particular markers by some federal, state, or local governments, etc.

With reference to the figures, FIG. 3 illustrates a multi-colored woven silt fence fabric 100 according to an exemplary embodiment of the present disclosure. In this example, the woven silt fence fabric 100 includes a first colored warp yarn having a first color (e.g., orange, black, green, yellow, red, blue, etc.) and second colored warp yarn having a second color (e.g., orange, black, green, yellow, red, blue, etc.) distinctly different than the first color of the first colored warp yarn. The first colored warp yarn is used for the first or lower woven fabric portion or section 104 that will be installed in the ground. The second colored warp yarn is used for the second or upper woven fabric portion or section 108 that will be installed above the ground. Accordingly, the woven silt fence fabric 100 thus includes the first or lower woven fabric portion or section 104 to be installed in the ground having the first color that is distinctly different from the second color of the second or upper woven fabric portion or section 108 to be installed above the ground.

FIG. 4 illustrates a multi-colored woven silt fence fabric 200 according to an exemplary embodiment of the present disclosure. In this example, the woven silt fence fabric 200 includes a first colored warp yarn, a second colored warp yarn, and a third colored yarn. The first colored warp yarn has a first color (e.g., orange, black, green, yellow, red, blue, etc.) distinctly different than a second color (e.g., orange, black, green, yellow, red, blue, etc.) of the second colored warp yarn. The third colored warp yarn has a third color (e.g., orange, black, green, yellow, red, blue, etc.) that is distinctly different from or the same as the first color and/or the second color. The first colored warp yarn is used for a first or lower woven fabric portion or section 204 that will be installed in the ground. The third colored warp yarn is used for a third or upper woven fabric portion or section 212 that will be installed above the ground. The second colored warp yarn is used for a second or medial woven fabric portion or section 208 that is between the first and third woven fabric portions or sections 204, 212 and that will also be installed above the ground.

In exemplary embodiments, a highly visible color is selected for the third woven fabric portion 212 such that the third woven fabric portion or section 212 will stand out from the natural surroundings in which the silt fence will be used. In which case, the third woven fabric portion or section 212 can thus serve the purpose of allowing the silt fence fabric to have a high visibility component that allows it to stand out from the natural surroundings in which it will be used.

FIG. 5 illustrates a multi-colored woven silt fence fabric 400 according to an exemplary embodiment of the present disclosure. In this example, the woven silt fence fabric 400 includes a first orange-colored warp yarn and a second black-colored warp yarn. The first orange-colored warp yarn is used for the first or lower woven fabric or section portion 404 that will be installed in the ground. The second black-colored warp yarn is used for the second or upper woven fabric portion or section 408 that will be installed above the ground.

In FIG. 5, the dimensions in inches, the color orange for the first or lower woven fabric portion or section 304, and the color black for the second or upper woven fabric portion or section 308 are provided for purpose of illustration only as other exemplary embodiments may be configured differently, e.g., with different colors (e.g., green, yellow, red, etc.), more colors, larger or smaller dimensions, more than two woven fabric portions or sections (e.g., three, four, five, more than five woven fabric portions or sections, etc.), etc.

In other exemplary embodiments, other colors (e.g., green, yellow, red, blue, yellow, black, etc.) besides orange may be used for the first or lower woven fabric portion or section 304 and/or other colors (e.g., green, red, blue, yellow, orange, etc.) besides black may be used for the second or upper woven fabric portion or section 308. Also, larger dimensions and/or smaller dimensions may be used for the silt fence fabric 300 in other exemplary embodiments, such as an overall height greater than or less than 36 inches (e.g., 30 inches, 42 inches, etc.), a height of the first or lower woven fabric portion or section 304 that is greater than or less than 6 inches (e.g., 4 inches, 8 inches, etc.), and/or a height of the second or upper fabric portion or section 308 that is greater than or less than 30 inches (e.g., 28 inches, 32 inches, etc.).

Figure 6:
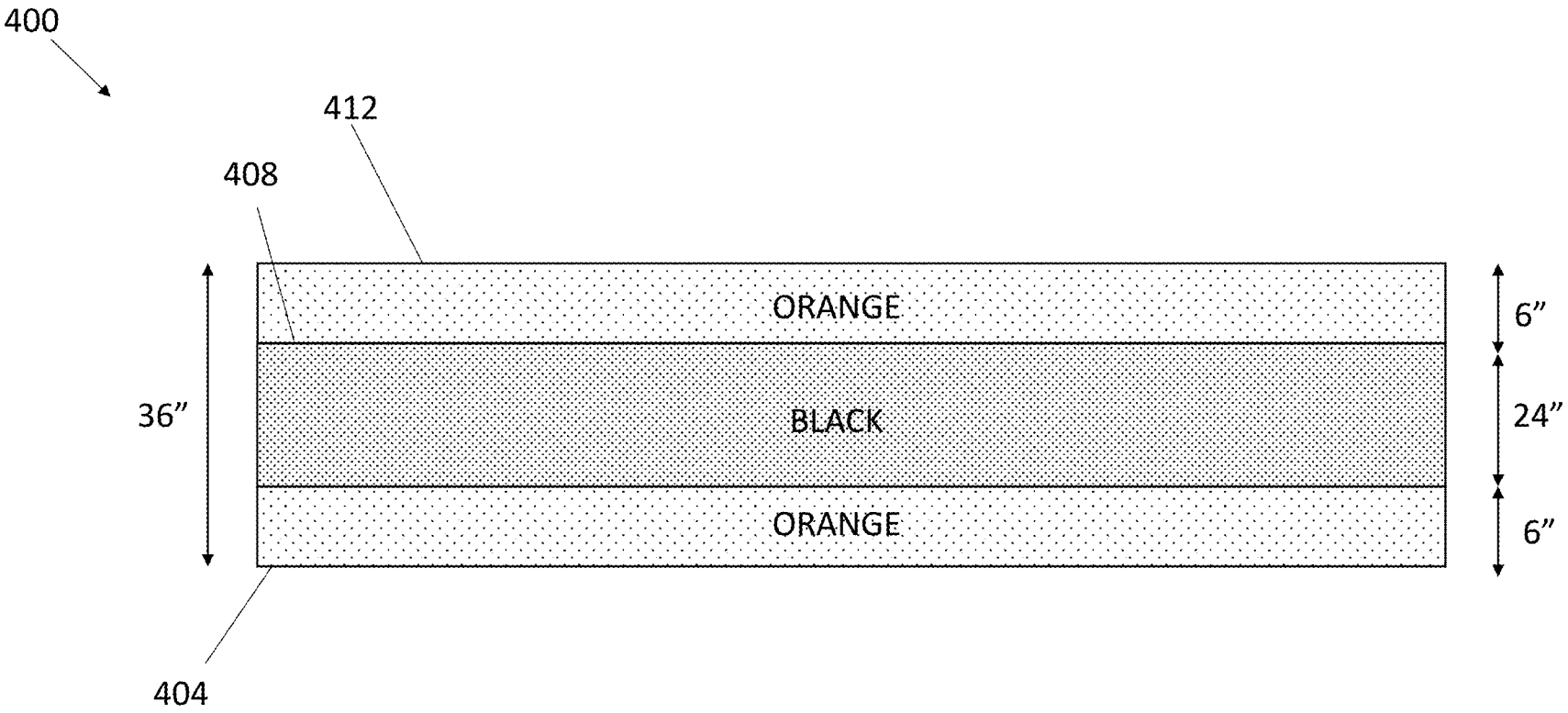
FIG. 6 illustrates a multi-colored woven silt fence fabric according to an exemplary embodiment of the present disclosure. The dimensions in inches and the colors are provided as examples only.

FIG. 6 illustrates a multi-colored woven silt fence fabric 200 according to an exemplary embodiment of the present disclosure. In this example, the woven silt fence fabric includes a first orange-colored warp yarn, a second black-colored warp yarn, and a third orange-colored yarn. The first orange-colored warp yarn is used for a first or lower woven fabric portion or section 404 that will be installed in the ground. The third orange-colored warp yarn is used for a third or upper woven fabric portion or section 412 that will be installed above the ground. The second black-colored warp yarn is used for a second or medial woven fabric portion or section 408 that is between the first and third woven fabric portions or sections 404, 412 and that will also be installed above the ground. In some cases, the third or upper woven fabric portion or section 412 can serve the purpose of allowing the fabric 400 to have a high visibility component that allows it to stand out from the natural surroundings.

In FIG. 6, the dimensions in inches, the color orange for the first or lower woven fabric portion or section 404, the color black for the second or medial woven fabric portion or section 408, and the color orange for the third or upper woven fabric portion or section 412 are provided for purpose of illustration only as other exemplary embodiments may be configured differently, e.g., with different colors (e.g., green, yellow, red, etc.), more colors, larger or smaller dimensions, more than three woven fabric portions or sections (e.g., four, five, more than five woven fabric portions or sections, etc.), etc.

In other exemplary embodiments, other colors (e.g., green, yellow, red, blue, yellow, black, etc.) besides orange may be used for the first or lower woven fabric portion or section 404 and/or for the third or upper woven fabric portion or section 412 and/or other colors (e.g., green, yellow, red, blue, yellow, orange, etc.) besides black may be used for the second or medial woven fabric portion or section 408. Also, larger dimensions and/or smaller dimensions may be used for the silt fence fabric 400 in other exemplary embodiments, such as an overall height greater than or less than 36 inches (e.g., 30 inches, 42 inches, etc.), a height of the first or lower woven fabric portion or section 404 that is greater than or less than 6 inches (e.g., 4 inches, 8 inches, etc.) and/or a height of the second or medial woven fabric portion or section 408 that is greater than or less than 24 inches (e.g., 22 inches, 26 inches, etc.) and/or a height of the third or upper woven fabric portion or section 412 that is greater than or less than 6 inches (e.g., 4 inches, 8 inches, etc.).

FIGS. 3 and 5 illustrate silt fence fabrics having first and second woven fabric portions or sections having respective first and second colors (e.g., green, yellow, red, blue, yellow, black, orange, etc.) that are distinctly different. FIGS. 4 and 6 illustrate silt fence fabrics having first, second, and third woven fabric portions or sections having respective first, second, and third colors (e.g., green, yellow, red, blue, yellow, black, orange, etc.) wherein at least one of the first, second, and third colors is distinctly different from at least one of the other first, second, and third colors. In other exemplary embodiments, the silt fence fabric includes more than three woven fabric portions or sections.

Figure 7:
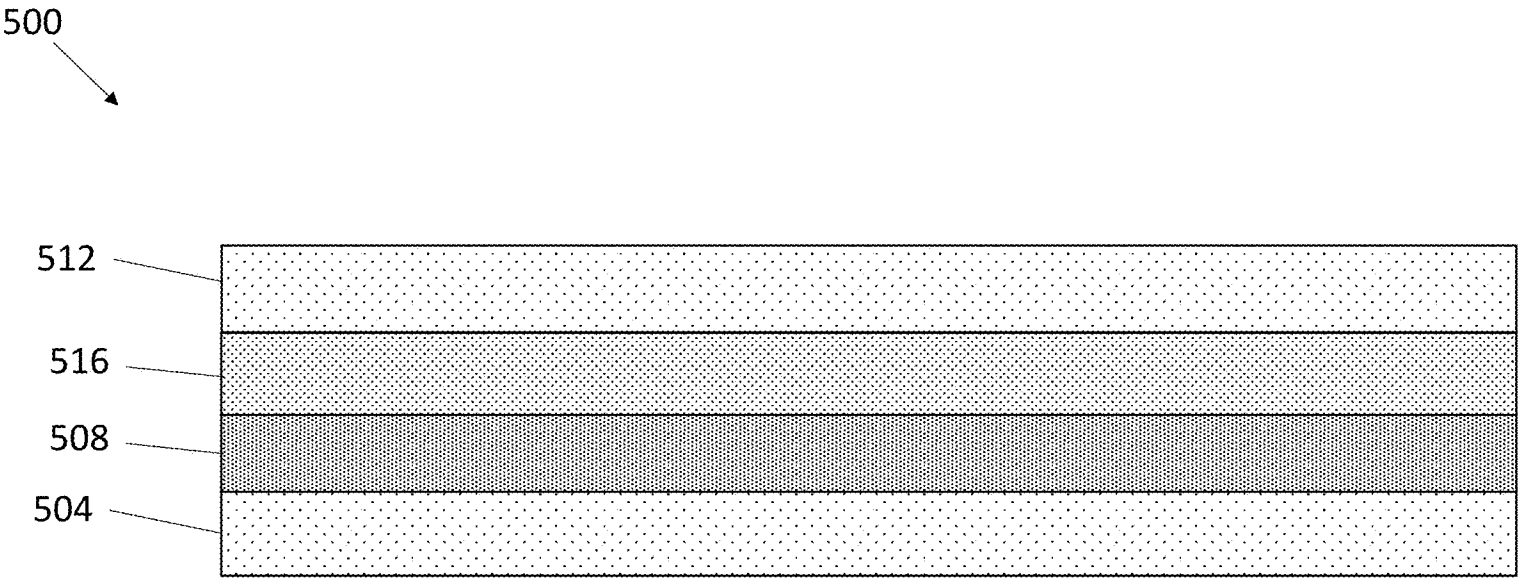
FIG. 7 illustrates a multi-colored woven silt fence fabric according to an exemplary embodiment of the present disclosure.

For example, FIG. 7 illustrates a multi-colored woven silt fence fabric 500 according to an exemplary embodiment of the present disclosure. In this example, the woven silt fence fabric 500 includes a first colored warp yarn, a second colored warp yarn, a third colored yarn, and a fourth colored warp yarn. At least one of the first, second, third, and fourth colored warp yarns has a color (e.g., orange, black, green, yellow, red, blue, etc.) distinctly different than a color (e.g., orange, black, green, yellow, red, blue, etc.) of at least one of the other warp yarns.

The first colored warp yarn is used for a first or lower woven fabric portion or section 504 that will be installed in the ground. The third colored warp yarn is used for a third or upper woven fabric portion or section 512 that will be installed above the ground. The second colored warp yarn is used for a second woven fabric portion or section 508. The fourth colored warp yarn is used for a fourth woven fabric portion or section 516.

The second woven fabric portion or section 508 is between the first and fourth woven fabric portions or sections 504, 516. The fourth woven fabric portion or section 516 is between the first and third woven fabric portions or sections 504, 516.

The woven silt fence fabric 500 thus includes the first, second, third, and fourth woven fabric portion or sections 504, 508, 512, and 516 having respective first, second, third, and fourth colors (e.g., orange, black, green, yellow, red, blue, etc.). And at least one of the first, second, third, and fourth colors is distinctly different from at least one of the other first, second, third, and fourth colors. By way of example only, the first and third woven fabric portions or sections 504, 512 may be orange, the second woven fabric portion or section 508 may be green, and the fourth woven fabric portion or section 516 may be black.

Figure 8:
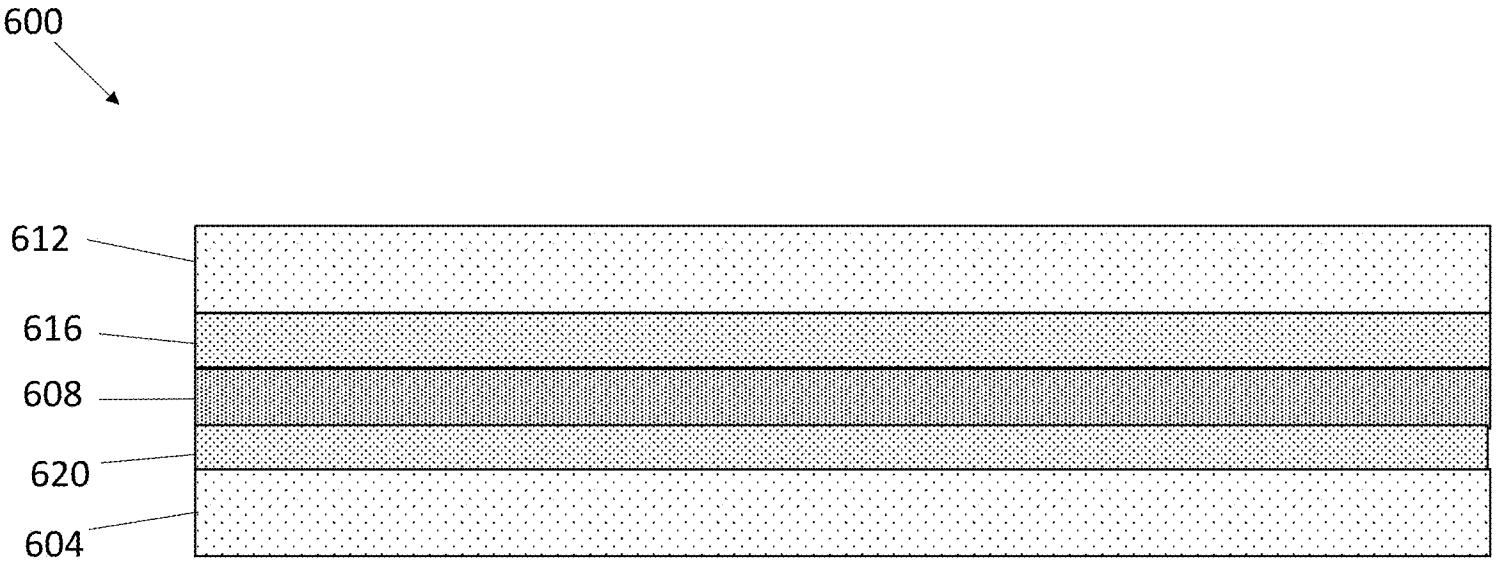
FIG. 8 illustrates a multi-colored woven silt fence fabric according to an exemplary embodiment of the present disclosure.

As a further example, FIG. 8 illustrates a multi-colored woven silt fence fabric 600 according to an exemplary embodiment of the present disclosure. In this example, the woven silt fence fabric 600 includes a first colored warp yarn, a second colored warp yarn, a third colored yarn, a fourth colored warp yarn, and a fifth colored warp yarn At least one of the first, second, third, fourth, and fifth colored warp yarns has a color (e.g., orange, black, green, yellow, red, blue, etc.) distinctly different than a color (e.g., orange, black, green, yellow, red, blue, etc.) of at least one of the other warp yarns.

The first colored warp yarn is used for a first or lower woven fabric portion or section 604 that will be installed in the ground. The third colored warp yarn is used for a third or upper woven fabric portion or section 612 that will be installed above the ground. The second colored warp yarn is used for a second woven fabric portion or section 608. The fourth colored warp yarn is used for a fourth woven fabric portion or section 616. The fifth colored warp yarn is used for a fifth woven fabric portion or section 620.

The second woven fabric portion or section 608 is between the fourth and fifth woven fabric portions or sections 616, 620. The fourth woven fabric portion or section 616 is between the second and third fabric portions or sections 608, 612. The fifth woven fabric portion or section 620 is between the first and second woven fabric portions or sections 604, 608.

The woven silt fence fabric 600 thus includes the first, second, third, fourth, and fifth woven fabric portion or sections 604, 608, 612, 616, 620 having respective first, second, third, fourth, and fifth colors (e.g., orange, black, green, yellow, red, blue, etc.). And at least one of the first, second, third, fourth, and fifth colors is distinctly different from at least one of the other first, second, third, fourth, and fifth colors. By way of example only, the first and third woven fabric portions or sections 604, 612 may be orange, the second woven fabric portion or section 608 may be green, and the fourth and fifth woven fabric portions or sections 616, 620 may be black.

In exemplary embodiments, the woven silt fence fabric has a lower grade line and an upper edge defining an installed height between the lower grade line and the upper edge. A first woven fabric portion or section extends or runs in a machine direction substantially parallel with a length of the woven silt fence fabric. A second woven fabric portion or section extends or runs in the machine direction substantially parallel with the length of the woven silt fence fabric. The woven silt fence fabric includes two or more distinctly different colors of warp yarns such that the first woven fabric portion or section has a first color (e.g., orange, green, yellow, red, blue, yellow, black, etc.) that is distinctly different from a second color (e.g., orange, green, yellow, red, blue, yellow, black, etc.) of the second woven fabric portion or section.

In exemplary embodiments, the first woven fabric portion or section defines a lower portion of the woven silt fence fabric including the lower grade line of the woven silt fence fabric. The first woven fabric portion or section is configured to be installed (e.g., inserted and buried, etc.) in the ground. The second woven fabric portion or section defines an upper portion of the woven silt fence fabric including the upper edge of the woven silt fence fabric. The second woven fabric portion or section is configured to be installed and remain exposed above the ground.

By way of example, the two or more distinctly different colors of warp yarns may comprise a first orange-colored warp yarn and a second black-colored warp yarn. The first woven fabric portion or section includes the first orange-colored warp yarn such that the first color of the first woven fabric portion or section is orange. And the second woven fabric portion or section includes the second black-colored warp yarn such that the second color of the second woven fabric portion or section is black. Other colors (e.g., green, yellow, red, blue, yellow, etc.) besides orange and black may be used for respective first and/or second woven fabric portion or sections or sections in other exemplary embodiments.

In exemplary embodiments, the woven silt fence fabric includes a third woven fabric portion or section that extends or runs in the machine direction substantially parallel with the length of the woven silt fence fabric. The second woven fabric portion or section is between the first and third woven fabric portions or sections. In such exemplary embodiments, the first woven fabric portion may be configured to be installed (e.g., inserted and buried, etc.) in the ground. And the second and third woven fabric portions or sections may be configured to be installed and remain exposed above the ground. The first woven fabric portion or section defines a lower portion of the woven silt fence fabric including the lower grade line of the woven silt fence fabric. The third woven fabric portion or section defines an upper portion of the woven silt fence fabric including the upper edge of the woven silt fence fabric. The second woven fabric portion or section defines a medial portion of the woven silt fence fabric extending or running between the first and third woven fabric portions or sections. The third woven fabric portion or section may have a third color that is distinctly different from or the same as the first or second colors.

In exemplary embodiments, the third woven fabric portion or section has a third color that is highly visible to stand out from natural surroundings. In which case, the third woven fabric portion or section can serve the purpose of allowing the fabric to have a high visibility component that allows it to stand out from the natural surroundings.

In exemplary embodiments, the two or more distinctly different colors of warp yarns may comprise a first orange colored warp yarn, a second black colored warp yarn, and a third orange colored warp yarn. The first woven fabric portion or section may include the first orange colored warp yarn such that the first color of the first woven fabric portion or section is orange. The second woven fabric portion or section may include the second black colored warp yarn such that the second color of the second woven fabric portion or section is black. And the third woven fabric portion or section may include the third orange colored warp yarn such that the third color of the third woven fabric portion or section is orange.

In exemplary embodiments, the two or more distinctly different colors of warp yarns comprise a first colored warp yarn, a second colored warp yarn, and a third colored warp yarn. The first woven fabric portion or section includes the first colored warp yarn such that the first color of the first woven fabric portion or section is one of orange, black, green, yellow, red, and blue. The second woven fabric portion or section includes the second colored warp yarn such that the second color of the second woven fabric portion or section is another one of orange, black, green, yellow, red, and blue that is distinctly different from the first color. And the third woven fabric portion or section includes the third colored warp yarn such that the third woven fabric portion has a third color that is orange, black, green, yellow, red, and blue.

In exemplary embodiments, the woven silt fence fabric comprises the first and second woven fabric portions or sections and one or more additional woven fabric portions or sections that extend or run in the machine direction substantially parallel with the length of the woven silt fence fabric. The one or more additional fabric portions or sections have one or more additional colors such that at least one of the one or more additional colors is distinctly different from at least one other of the first, second, and one or more additional colors.

In exemplary embodiments, the woven silt fence fabric comprises the first and second woven fabric portions or sections and a third woven fabric portion or section that extends or runs in the machine direction substantially parallel with the length of the woven silt fence fabric. The third woven fabric portion or section has a third color that is distinctly different from the first color and/or the second color. The woven silt fence fabric may also include a fourth woven fabric portion or section that extends or runs in the machine direction substantially parallel with the length of the woven silt fence fabric. In such exemplary embodiments, the fourth woven fabric portion or section has a fourth color that is distinctly different from at least one of the first, second, and third colors. The woven silt fence fabric may further include a fifth woven fabric portion or section that extends or runs in the machine direction substantially parallel with the length of the woven silt fence fabric. In such exemplary embodiments, the fifth woven fabric portion or section has a fifth color that is distinctly different from at least one of the first, second, third, and fourth colors.

The two or more distinctly different colors of warp yarns may comprise two or more of the same yarn types or two or more different yarn types, which yarn types may include one or more of tape yarn, fibrillated tape yarn, monofilament yarn, multifilament yarn, and/or spun yarn of any type.

The two or more distinctly different colors of warp yarns may have the same cross-sectional shape or different cross-sectional shapes.

The two or more distinctly different colors of warp yarns may have the same denier or different deniers.

The two or more distinctly different colors of warp yarns may have the same cross-sectional shape or different cross-sectional shapes, which cross-sectional shape(s) may include one or more of round, flat, multilobal, oval, trilobal, triangular, rectangular, non-circular, and/or non-rectangular.

By way of example, the warp yarns may comprise flat/oval monofilament with denier ranges from 500 to 1800 denier, round monofilament with denier ranges from 500 to 2000 denier, and/or fibrillated tape yarns with denier ranges from 1000 to 15,000 denier.

Also by way of example, the two or more distinctly different colors of warp yarns may comprise fibrillated tape yarn. A fibrillated tape yarn typically features a rectangular cross-section designed to conform to the woven construction of the fabric it is incorporated into. This type of yarn undergoes a modification process during manufacturing, where "cuts or slits" are added, making it more adaptable to the fabric's construction. In loosely woven fabrics, the fibrillated tape yarn can lie relatively flat, while in tightly woven fabrics, the fibrillated tape yarn tends to assume a round cross-sectional shape. Exemplary embodiments disclosed herein may utilize fibrillated warp yarns because fibrillated tape yarn enables the incorporation of large yarns into very small spaces by cramming, packing, inserting, or weaving them in.

The woven silt fence fabric also includes one or more fill yarns that extend or run in a cross machine/transverse direction substantially parallel with the installed height. The one or more fill yarns may comprise different yarn type(s) than or the same yarn type(s) as the two or more distinctly different colors of warp yarns, which yarn type(s) may include one or more of tape yarn, fibrillated tape yarn, monofilament yarn, multifilament yarn, and/or spun yarn of any type. The one or more fill yarns may have a cross-sectional shape(s) that is the same as or different from each other, which cross-sectional shape(s) may include one or more of round, flat, multilobal, oval, trilobal, triangular, rectangular, non-circular, and/or non-rectangular.

In exemplary embodiments, the one or more fill yarns may comprise two or more fill yarns that are the same yarn types or different yarn types. For example, the two or more fill yarns have a same cross-sectional shape or different cross-sectional shapes. And the two or more fill yarns may have the same denier or different deniers.

By way of example, the one or more fill yarns may comprise flat/oval monofilament with denier ranges from 500 to 1800 denier, round monofilament with denier ranges from 500 to 2000 denier, and/or fibrillated tape yarns with denier ranges from 1000 to 15,000 denier.

Also by way of example, the one or more fill yarns may comprise fibrillated tape yarn. A fibrillated tape yarn typically features a rectangular cross-section designed to conform to the woven construction of the fabric it is incorporated into. This type of yarn undergoes a modification process during manufacturing, where "cuts or slits" are added, making it more adaptable to the fabric's construction. In loosely woven fabrics, the fibrillated tape yarn can lie relatively flat, while in tightly woven fabrics, it tends to assume a round shape. Exemplary embodiments disclosed herein may utilize fibrillated fill yarns because they enable the incorporation of large yarns into very small spaces by cramming, packing, inserting, or weaving them in.

In exemplary embodiments, the woven silt fence fabric is configured to have physical and/or mechanical properties that are anisotropic in regard to the warp or fill construction. In other exemplary embodiments, the woven silt fence fabric is configured to have physical and/or mechanical properties that are isotropic in regard to the warp and fill construction.

In exemplary embodiments, the two or more distinctly different colors of warp yarns comprise a first colored warp yarn and a second colored warp yarn. The first woven fabric portion includes the first colored warp yarn such that the first color of the first woven fabric portion is one of orange, black, green, yellow, red, and blue. And the second woven fabric portion includes the second colored warp yarn such that the second color of the second woven fabric portion is another one of orange, black, green, yellow, red, and blue that is distinctly different from the first color.

Also disclosed are exemplary woven silt fences that comprise a woven silt fence fabric as disclosed herein. In such exemplary embodiments, one or more support posts may be configured for attachment to the woven silt fence fabric for supporting the woven silt fence such that the first woven fabric portion or section is installed in the ground and the second woven fabric portion or section is installed above the ground.

Exemplary methods of weaving woven silt fence fabrics are disclosed. In exemplary embodiments, a method includes weaving one or more fill yarns and two or more distinctly different colors of warp yarns to thereby provide a woven silt fence fabric including: a first woven fabric portion or section that extends or runs in a machine direction substantially parallel with a length of the woven silt fence fabric; and a second woven fabric portion or section that extends or runs in the machine direction substantially parallel with the length of the woven silt fence fabric. The first woven fabric portion or section has a first color that is distinctly different from a second color of the second woven fabric portion.

In exemplary embodiments, the weave pattern used for the woven silt fence fabric may comprise a plain or 1×1 weave, any twill weave (e.g., 2×1, 2×2, 3×1, 3×3, 4×4, etc.), herringbones, satin, baskets, leno, etc.

In exemplary embodiments, the warp yarns and/or fill yarns of the woven silt fence fabric may comprise flat/oval monofilament with denier ranges from 500 to 1800 denier, round monofilament with denier ranges from 500 to 2000 denier, and/or fibrillated tape yarns with denier ranges from 1000 to 15,000 denier.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected, or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A woven silt fence fabric for a woven silt fence for erosion control, the woven silt fence fabric having a lower grade line and an upper edge defining an installed height between the lower grade line and the upper edge, the woven silt fence fabric comprising:

a first woven fabric portion that extends or runs in a machine direction substantially parallel with a length of the woven silt fence fabric;

a second woven fabric portion that extends or runs in the machine direction substantially parallel with the length of the woven silt fence fabric; and two or more distinctly different colors of warp yarns such that the first woven fabric portion has a first color that is distinctly different from a second color of the second woven fabric portion;

wherein the first woven fabric portion includes opposite front and back sides, and an entirety of the first woven fabric portion including the opposite front and back sides of the first woven fabric portion have the first color; and wherein the second woven fabric portion includes opposite front and back sides, and an entirety of the second woven fabric portion including the opposite front and back sides of the second woven fabric portion have the second color that is distinctly different from the first color.

2. The woven silt fence fabric of claim 1, wherein:

the first woven fabric portion is configured to be installed in the ground; and the second woven fabric portion is configured to be installed above the ground;

whereby the distinctly different first and second colors of the respective first and second woven fabric portions facilitate proper installation of the woven silt fence and provide a high visibility component that stands out from the natural surroundings in which the woven silt fence is used.

3. The woven silt fence fabric of claim 1, wherein:

the first woven fabric portion defines a lower portion of the woven silt fence fabric including the lower grade line of the woven silt fence fabric;

the second woven fabric portion defines an upper portion of the woven silt fence fabric including the upper edge of the woven silt fence fabric;

the lower portion of the woven silt fence fabric is defined by the first woven fabric portions such that front and back opposite sides of the lower portion of the woven silt fence fabric including an entire height and width of the front and back opposite sides of the lower portion of the woven silt fence fabric have the first color; and the upper portion of the woven silt fence fabric is defined by the second woven fabric portions such that front and back opposite sides of the upper portion of the woven silt fence fabric including an entire height and width of the front and back opposite sides of the upper portion of the woven silt fence fabric have the second color that is distinctly different from the first color.

4. The woven silt fence fabric of claim 1, wherein:

the two or more distinctly different colors of warp yarns comprise a first orange-colored warp yarn and a second black-colored warp yarn;

the first woven fabric portion includes the first orange-colored warp yarn such that the first color of the first woven fabric portion is orange; and the second woven fabric portion includes the second black-colored warp yarn such that the second color of the second woven fabric portion is black.

5. The woven silt fence fabric of claim 1, further comprising a third woven fabric portion that extends or runs in the machine direction substantially parallel with the length of the woven silt fence fabric, wherein the second woven fabric portion is between the first and third woven fabric portions.

6. The woven silt fence fabric of claim 5, wherein:
the first woven fabric portion is configured to be installed in the ground; and
the second and third woven fabric portions are configured to be installed above the ground.

7. The woven silt fence fabric of claim 5, wherein:
the first woven fabric portion defines a lower portion of the woven silt fence fabric including the lower grade line of the woven silt fence fabric;
the third woven fabric portion defines an upper portion of the woven silt fence fabric including the upper edge of the woven silt fence fabric; and
the second woven fabric portion defines a medial portion of the woven silt fence fabric extending or running between the first and third woven fabric portions.

8. The woven silt fence fabric of claim 7, wherein the third woven fabric portion has a third color that is highly visible to stand out from natural surroundings thereby making the silt fence more visible from the natural surroundings in which the silt fence is used for easier demarcation/identification of a perimeter or zone defined by the silt fence and confirmation of proper installation of the silt fence.

9. The woven silt fence fabric of claim 7, wherein:
the two or more distinctly different colors of warp yarns comprise a first orange colored warp yarn, a second black colored warp yarn, and a third orange colored warp yarn;
the first woven fabric portion includes the first orange colored warp yarn such that the first color of the first woven fabric portion is orange;
the second woven fabric portion includes the second black colored warp yarn such that the second color of the second woven fabric portion is black; and
the third woven fabric portion includes the third orange colored warp yarn such that the third woven fabric portion is orange.

10. The woven silt fence fabric of claim 5, wherein the third woven fabric portion has a third color that is distinctly different from the first color and/or the second color.

11. The woven silt fence fabric of claim 5, wherein the third woven fabric portion has a third color that is the same as the first color or the second color.

12. The woven silt fence fabric of claim 5, wherein:
the two or more distinctly different colors of warp yarns comprise a first colored warp yarn, a second colored warp yarn, and a third colored warp yarn;
the first woven fabric portion includes the first colored warp yarn such that the first color of the first woven fabric portion is one of orange, black, green, yellow, red, and blue;
the second woven fabric portion includes the second colored warp yarn such that the second color of the second woven fabric portion is another one of orange, black, green, yellow, red, and blue that is distinctly different from the first color; and
the third woven fabric portion includes the third colored warp yarn such that the third woven fabric portion has a third color that is orange, black, green, yellow, red, and blue.

13. The woven silt fence fabric of claim 1, further comprising one or more additional woven fabric portions that extend or run in the machine direction substantially parallel with the length of the woven silt fence fabric, the one or more additional fabric portions having one or more additional colors such that at least one of the one or more additional colors is distinctly different from at least one other of the first, second, and one or more additional colors.

14. The woven silt fence fabric of claim 1, further comprising a third woven fabric portion that extends or runs in the machine direction substantially parallel with the length of the woven silt fence fabric, the third woven fabric portion having a third color that is distinctly different from the first color and/or the second color.

15. The woven silt fence fabric of claim 14, further comprising a fourth woven fabric portion that extends or runs in the machine direction substantially parallel with the length of the woven silt fence fabric, the fourth woven fabric portion having a fourth color that is distinctly different from at least one of the first, second, and third colors.

16. The woven silt fence fabric of claim 15, further comprising a fifth woven fabric portion that extends or runs in the machine direction substantially parallel with the length of the woven silt fence fabric, the fifth woven fabric portion having a fifth color that is distinctly different from at least one of the first, second, third, and fourth colors.

17. The woven silt fence fabric of claim 1, wherein the two or more distinctly different colors of warp yarns comprise two or more of the same yarn types or two or more different yarn types from each other.

18. The woven silt fence fabric of claim 1, wherein the two or more distinctly different colors of warp yarns comprise one or more of tape yarn, fibrillated tape yarn, monofilament yarn, multifilament yarn, and/or spun yarn of any type.

19. The woven silt fence fabric of claim 1, wherein the two or more distinctly different colors of warp yarns have the same cross-sectional shape or different cross-sectional shapes from each other.

20. The woven silt fence fabric of claim 1, wherein the two or more distinctly different colors of warp yarns have the same denier or different deniers from each other.

21. The woven silt fence fabric of claim 1, wherein:
the two or more distinctly different colors of warp yarns have the same cross-sectional shape or different cross-sectional shapes from each other; and
a cross-sectional shape(s) of the two or more distinctly different colors of warp yarns include one or more of round, flat, multilobal, oval, trilobal, triangular, rectangular, non-circular, and/or non-rectangular.

22. The woven silt fence fabric of claim 1, wherein the two or more distinctly different colors of warp yarns comprise one or more of:
flat/oval monofilament with denier ranges from 500 to 1800 denier;
round monofilament with denier ranges from 500 to 2000 denier; and/or
fibrillated tape yarn with denier ranges from 1000 to 15,000 denier.

23. The woven silt fence fabric of claim 1, wherein the woven silt fence fabric includes one or more fill yarns that extend or run in a cross machine/transverse direction substantially parallel with the installed height.

24. The woven silt fence fabric of claim 23, wherein:
the one or more fill yarns are different yarn type(s) than or the same yarn type(s) as the two or more distinctly different colors of warp yarns; and/or
the one or more fill yarns comprise one or more of tape yarn, fibrillated tape yarn, monofilament yarn, multifilament yarn, and/or spun yarn of any type; and/or
the one or more fill yarns have a cross-sectional shape(s) that is the same as or different from each other, the cross-sectional shape(s) including one or more of round, flat, multilobal, oval, trilobal, triangular, rectangular, non-circular, and/or non-rectangular.

25. The woven silt fence fabric of claim 23, wherein the one or more fill yarns comprise two or more fill yarns that are the same yarn types or different yarn types from each other.

26. The woven silt fence fabric of claim 25, wherein:

the two or more fill yarns have a same cross-sectional shape or different cross-sectional shapes from each other; and/or the two or more fill yarns have the same denier or different deniers from each other.

27. The woven silt fence fabric of claim 23, wherein the one or more fill yarns comprise one or more of:

flat/oval monofilament with denier ranges from 500 to 1800 denier;

round monofilament with denier ranges from 500 to 2000 denier; and/or fibrillated tape yarn with denier ranges from 1000 to 15,000 denier.

28. The woven silt fence fabric of claim 1, wherein the woven silt fence fabric is configured to have physical and/or mechanical properties that are anisotropic in regard to the warp or fill construction.

29. The woven silt fence fabric of claim 1, wherein the woven silt fence fabric is configured to have physical and/or mechanical properties that are isotropic in regard to the warp and fill construction including along the first and second woven fabric portions such that the distinctly different first and second colors of the respective first and second woven fabric portions do not designate portions of the woven silt fence fabric having different physical and/or mechanical properties.

30. The woven silt fence fabric of claim 1, wherein:

the two or more distinctly different colors of warp yarns comprise a first colored warp yarn and a second colored warp yarn;

the first woven fabric portion includes the first colored warp yarn such that the first color of the first woven fabric portion is one of orange, black, green, yellow, red, and blue; and the second woven fabric portion includes the second colored warp yarn such that the second color of the second woven fabric portion is another one of orange, black, green, yellow, red, and blue that is distinctly different from the first color.

31. A woven silt fence for erosion control, the woven silt fence comprising the woven silt fence fabric of claim 1, and further comprising one or more support posts configured for attachment to the woven silt fence fabric for supporting the woven silt fence such that the first woven fabric portion is installed in the ground and the second woven fabric portion is installed above the ground, whereby the distinctly different first and second colors of the respective first and second woven fabric portions facilitate proper installation of the woven silt fence and provide a high visibility component that stands out from the natural surroundings in which the woven silt fence is used.

32. A method comprising weaving one or more fill yarns and two or more distinctly different colors of warp yarns to thereby provide a woven silt fence fabric for a woven silt fence for erosion control including:

a first woven fabric portion that extends or runs in a machine direction substantially parallel with a length of the woven silt fence fabric; and a second woven fabric portion that extends or runs in the machine direction substantially parallel with the length of the woven silt fence fabric;

the first woven fabric portion having a first color that is distinctly different from a second color of the second woven fabric portion;

wherein the first woven fabric portion includes opposite front and back sides, and an entirety of the first woven fabric portion including the opposite front and back sides of the first woven fabric portion have the first color; and wherein the second woven fabric portion includes opposite front and back sides, and an entirety of the second woven fabric portion including the opposite front and back sides of the second woven fabric portion have the second color that is distinctly different from the first color;

whereby the distinctly different first and second colors of the respective first and second woven fabric portions facilitate proper installation of the woven silt fence and provide a high visibility component that stands out from the natural surroundings in which the woven silt fence is used.

33. A method of using a woven silt fence for erosion control, the woven silt fence including a woven silt fence fabric comprising a first woven fabric portion that extends or runs in a machine direction substantially parallel with a length of the woven silt fence fabric, and a second woven fabric portion that extends or runs in the machine direction substantially parallel with the length of the woven silt fence fabric, the first woven fabric portion having a first color that is distinctly different from a second color of the second woven fabric portion, wherein:

the method comprises using one or more support posts for supporting the woven silt fence such that the first woven fabric portion is installed in the ground and the second woven fabric portion is installed above the ground;

the first woven fabric portion includes opposite front and back sides;

an entirety of the first woven fabric portion including the opposite front and back sides of the first woven fabric portion have the first color;

the second woven fabric portion includes opposite front and back sides;

an entirety of the second woven fabric portion including the opposite front and back sides of the second woven fabric portion have the second color that is distinctly different from the first color; and the distinctly different first and second colors of the respective first and second woven fabric portions facilitate proper installation of the woven silt fence and provide a high visibility component that stands out from the natural surroundings in which the woven silt fence is used.

* * * * *